United States Patent [19]

Ericson et al.

[11] Patent Number: 5,002,158

[45] Date of Patent: Mar. 26, 1991

[54] ELEVATOR SAFETY

[75] Inventors: Richard Ericson; William Sheridan, both of Southington, Conn.

[73] Assignee: Otis Elevator Company, Farmington, Conn.

[21] Appl. No.: 562,364

[22] Filed: Aug. 3, 1990

[51] Int. Cl.[5] ..... B66B 5/22

[52] U.S. Cl. ..... 187/39; 187/20; 187/30; 187/38; 187/88; 188/76

[58] Field of Search ..... 187/20, 30, 31, 32, 187/38, 39, 73, 74, 77, 88, 89, 108, 109; 188/76, 82.84, 188

[56] References Cited

U.S. PATENT DOCUMENTS

| | | | |
|---|---|---|---|
| 3,171,348 | 3/1965 | Wetzer | 188/82.84 X |
| 3,516,304 | 6/1970 | Vermette | 187/88 X |
| 3,762,512 | 10/1973 | McIntyre | 187/88 X |
| 3,819,015 | 6/1974 | Silberschlag | 188/76 X |
| 4,538,706 | 9/1985 | Koppensteiner | 187/90 |
| 4,928,796 | 5/1990 | Poon | 187/89 |

*Primary Examiner*—Robert P. Olszewski
*Assistant Examiner*—Dean A. Reichard
*Attorney, Agent, or Firm*—Edward L. Kochey, Jr.

[57] ABSTRACT

A safety braking disk (56) is secured to rope drive sheave (14). First (52) and second (54) safety brake assemblies each operate on opposing parallel sides of the disk. Brake pads (60) are resiliently placed into engagement upon initiation of the safety. The safety is initiated upon car overspeed, movement with open car doors, or excess velocity in the leveling zone.

8 Claims, 3 Drawing Sheets

ELEVATOR SAFETY

TECHNICAL FIELD

The invention relates to safeties for stopping an elevator car and the counterweight, and in particular to a progressive safety adapted for use in large elevators.

BACKGROUND OF THE INVENTION

Electric elevators conventionally have a car and a counterweight with these being connected by elevator ropes passing over a support sheave. The counterweight is selected of a weight between the empty and fully loaded weight of the car. Normal braking is accomplished by controlling the drive motor speed and torque to bring the car to a complete stop at the floor. Once at the floor, or near the floor for some control systems power is removed from the drive motor and a spring loaded friction brake is used to stop and hold or hold the car at the floor.

A safety is located on the car frame which engages the guide rails on downward overspeed of the car. Such engagement of the rails is not desirable in the upward direction because of the possibility of stopping with a greater than 1-G deceleration if the safety jams.

It is also known to prevent energization of the drive motor when the doors are open and the car is at a distance greater than a preselected distance from a landing. Some discrete movement is desirable to permit leveling of the elevator car, provided that the car is within close proximity of the landing with the doors open.

It is also possible, however, to experience an upward overspeed of the car. For instance this can occur with malfunction of the brake or control system and a lightly loaded car. This is particularly a problem when the car is at a low elevation so that substantial speed can be obtained by the time the car reaches the overhead building structure.

Movement from the floor can possibly occur even with the drive motor deenergized. Therefore, it is desirable to have a safety braking action to stop movement of the car beyond a predetermined distance with the doors open.

Certain elevator code regulations are in progress requiring a safety on upward overspeed and also on movement up or down beyond a specified distance with the elevator doors open. These codes will normally require that the safety braking system be independent of the regular controls.

A so called "Austrian safety", as illustrated in U.S. Pat. No. 4,538,706, has been successfully used on many elevators. This safety operates on the guide rail of the elevator and has found extensive use in smaller and low speed elevators. With large, high speed elevators, however, increased clearance for roller guide motion is required between the elevator car guides and the rail. Accordingly, the Austrian safety has not found success there because of the extensive clearance required. Since such Austrian safety is substantially a standard part, it would be desirable to have an arrangement wherein such safety could be applied to larger elevators.

SUMMARY OF THE INVENTION

In a conventional elevator rope supported car and counterweight elevator system the drive sheave can have secured thereto an annularly disposed disk, with this disk having parallel axially facing braking surfaces. The safety block assembly is then secured to a machined plate support structure which is adapted to receiving the disk and includes a brake shoe attached to the safety block assembly located on one side of the disk.

A spring assembly also attached to the housing is located to define a tapered area on a second side of the disk opposite the first side on which the brake shoe is located. A roller located within the tapered area is adapted to be directed initially toward the narrow end, whereby it engages the second side of the disk and is forced progressively further toward the narrow end by rolling on the disk as the disk rotates. This draws the brake shoe into contact with the other side of the disk with progressively increasing force resiliently effected by the spring assembly.

A stop in the housing at the narrow end limits the travel of the roller. This limit is at a point where spring resiliency is still effective, so that the braking force is limited. An initiation means operates to initially direct the roller toward the narrow end to initiate the braking action.

A second similar assembly is located at a second circumferential location around the disk, with the second assembly facing in the opposite direction with respect to the rotation of the disk. Therefore, when both the first and second assemblies are initiated, one of the two will be in a position to accomplish the braking with a selection inherently being made depending on the rotation of the disk.

The electrical tripping means of safeties may be arranged to either energize to initiate braking or deenergize to initiate braking. The safety system is initiated upon detection of an overspeed condition in either direction of the elevator car. It is also initiated during any operation greater than the leveling speed of the car together with the car door being open, and the car located anywhere outside any floor landing leveling zone. Furthermore, it is initiated any time that the car is moving greater than at leveling speed within the leveling zone of any elevation where there is a call to stop, either from the car or from the hall.

DESCRIPTION OF THE PREFERRED EMBODIMENT

Figure 1:
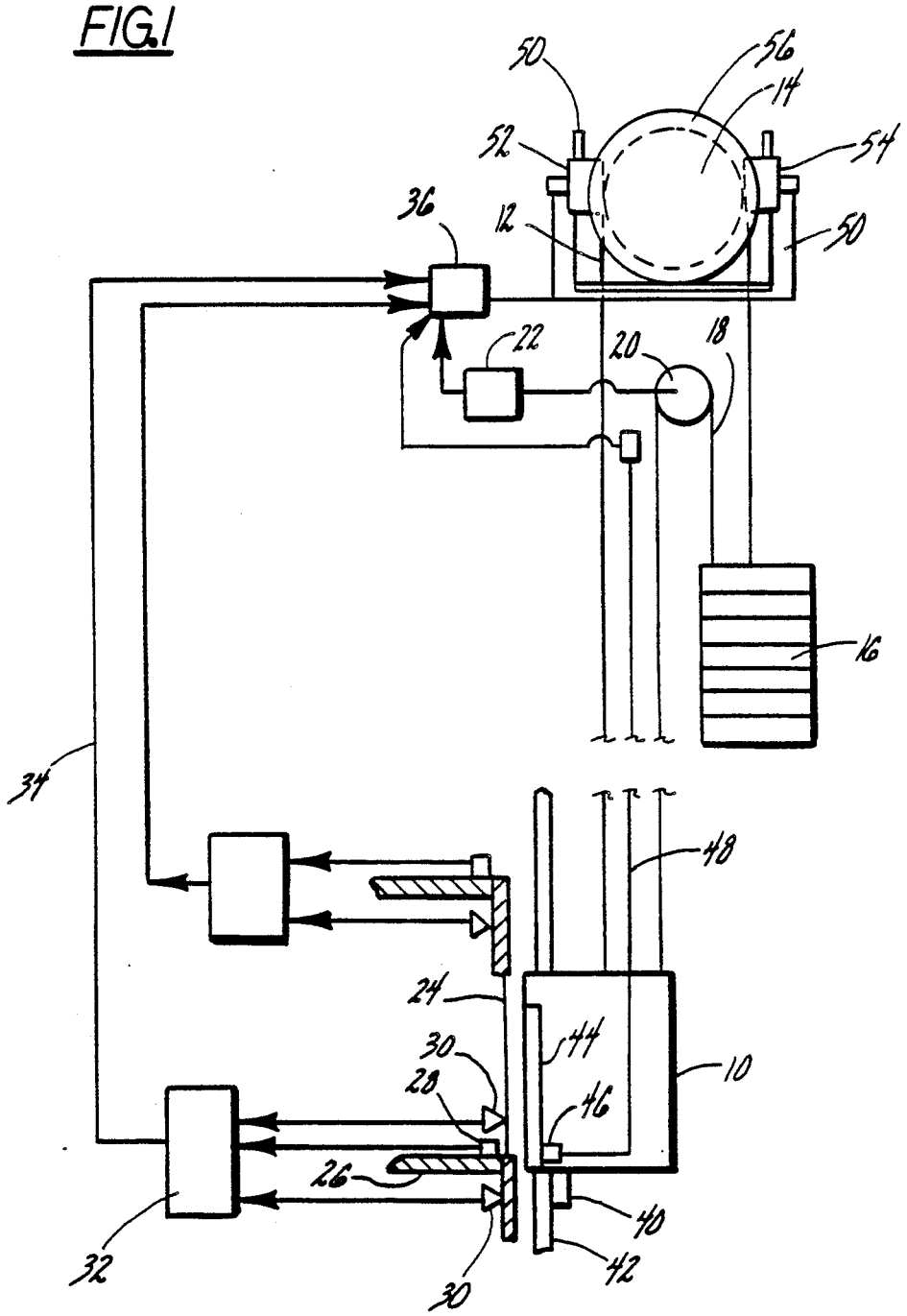
FIG. 1 is a schematic showing the elevator system.
Figure 2:
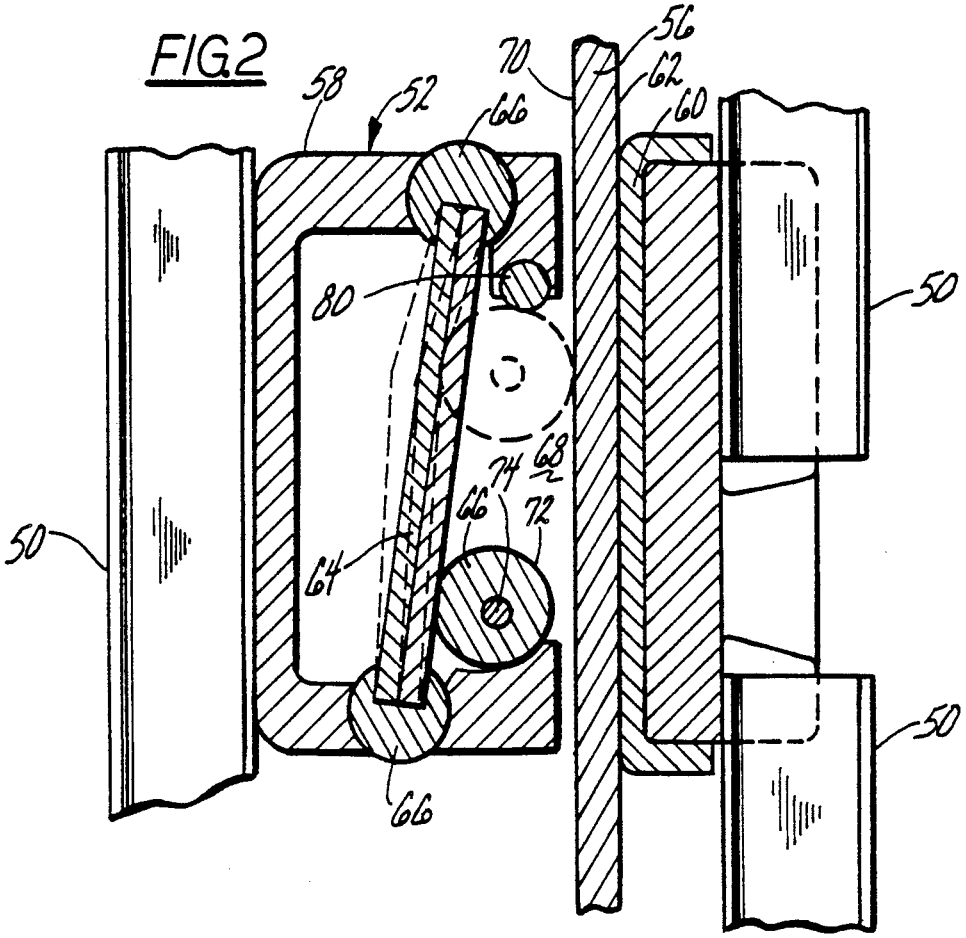
FIG. 2 is a sectional side elevation of the braking assembly.
Figure 3:
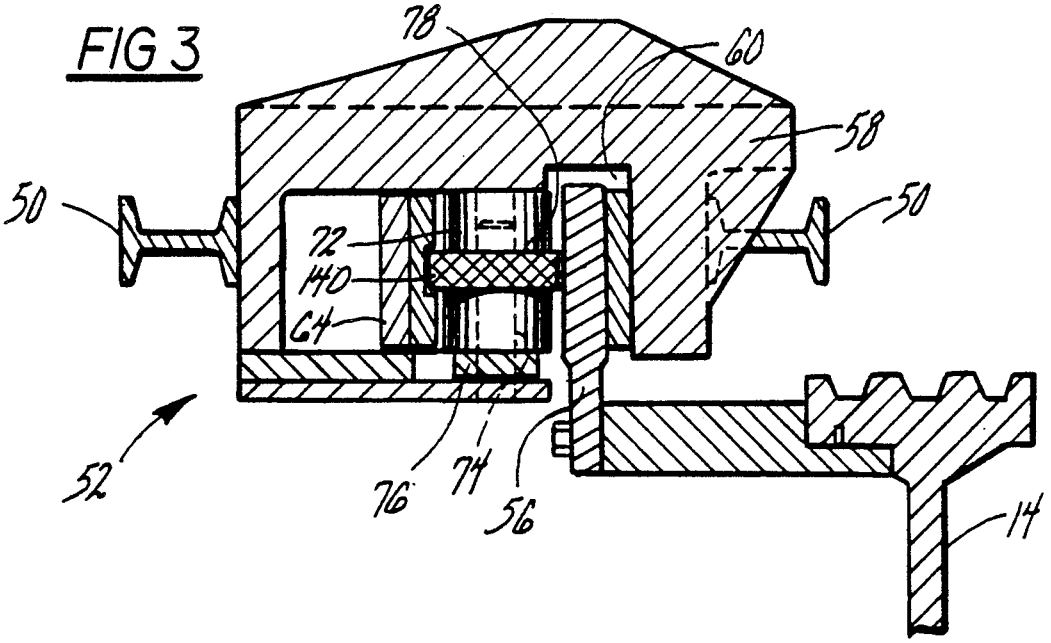
FIG. 3 is a sectional plan elevation of the braking assembly.

Car 10 is supported by elevator rope 12 passing over sheave 14 and secured to counterweight 16. A secondary rope 18 passes over idler pulley 20 enabling tachometer 22 or overspeed governor to determine the direction and rate of travel of the car. Hall doors 24 at landing 26 include detection means 28 for detecting a door open condition. Level sensors 30 detect the location of the car with respect to the landing and define therebetween a leveling zone wherein an elevator car intended to stop at this elevation should be traveling at a preselected leveling speed, for instance less than 10 feet per minute. Actual leveling speed can vary somewhat depending on various control system design parameters.

Level sensors 30 may be combined with door open sensor 28 in controller 32 to determine whether the car has moved beyond a preselected distance from the landing with the doors open. The various control signals are passed through control line 34 from controller 32 to the safety brake controller 36.

The conventional safety 40 operates on rail 42 to stop car 10 on the downward overspeed. Within car 10 are located car doors 44 and a car door open sensor 46. This transmits a door open signal through control line 48 to controller 36.

Support structure 50 supports a first brake assembly 52 and a second brake assembly 54 adjacent sheave 14. While this braking disk is most conveniently secured to the sheave, a disk secured to the shaft on which the sheave is mounted, would be the functional equivalent. An annular braking disk 56 is located on the sheave with each of the brake assemblies being adapted to receive this disk. Brake assembly 52 and brake assembly 54 are identical except that they are oppositely directed with respect to the direction of rotation of the sheave 14.

Safety brake assembly 52 includes housing 58 which carries a brake pad 60 abutable with the first side 62 of disk 56. A spring assembly 64 is secured to the housing preferably by freely supported end bearings 66, and defines a tapered area 68 between the spring and the second side 70 of the disk 56.

A roller 72 has a pin 74 supported within a slot in linkage 76. Braking action is initiated by raising linkage 76 bringing the narrow surface 78 of roller 72 into contact with both the spring 64 and the disk 56. This causes the roller to move progressively more upwardly in response to the rotation of the disk. The brake pad 60 is brought into contact with the disk with the force progressively increasing in response to upward movement of the roller and deflection of the spring. Stop 80 operates to limit the movement of the roller. The stop is located so that the maximum braking force is limited by the resiliency of the spring.

The braking disk secured to the sheave is not subject to variations in its location with respect to the braking structure as compared to the variations in the guide rail in the prior art. Accordingly, even large elevators may use this type of braking apparatus without concern for necessary clearances between the brake pad and the roller. Since two brake assemblies 52 and 54 are established in opposite directions with respect to rotation of the disk, rotation in one direction will automatically progressively engage the initiated roller 72 of one braking system while the other braking system will have no effect because of the opposite movement. The operation of linkage 76 is described in response to the control systems set forth below.

Figure 4:
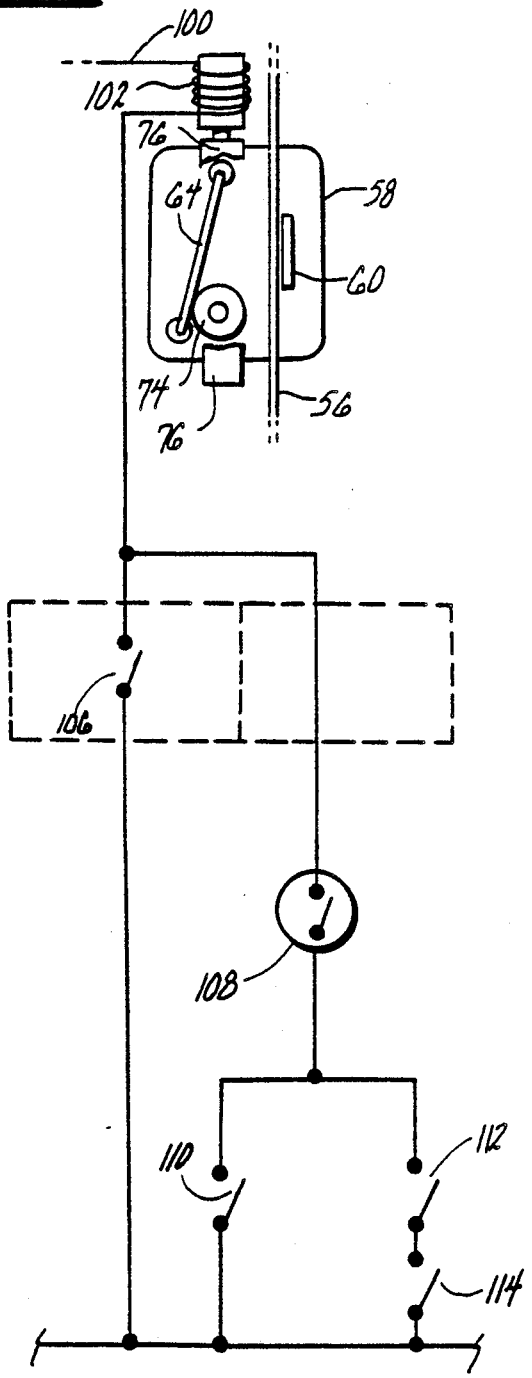
FIG. 4 is a control diagram of an energize to trip system.

FIG. 4 represents a control schematic of a normally deenergized and therefore energize to actuate system. Voltage is applied at terminal 100 on one side of solenoid 102. When energized, the solenoid operates to lift linkage 76 to bring roller 74 into engagement. Wired between the first terminal and a ground line 104 (not shown) normally open governor overspeed switch 106 is located. This completes this circuit and energizes the brake in response to governor overspeed as detected by speed detector or tachometer 22. In parallel with the governor overspeed switch is a sheave mounted velocity transducer 108 which detects whether or not the velocity is below the leveling speed of 10 feet per minute. This switch is open if the speed is above the preselected value and closed if it is less than the preselected value.

A car velocity greater than the leveling speed of 10 feet a minute or other system specified leveling speed should never occur within the leveling zone if the car is to stop at that level because of a call signal either from the car or the hall. Neither should it occur anytime that the car door is open. According, this contact is placed in series with contact 110 which is open with the door closed, but closed with the door open. In parallel with switch 110 is switch 112 being opened in a leveling zone, but closed outside the leveling zone. Further in series with switch 112 is switch 114 which is closed if there is a call for the car to stop at a particular location and otherwise open.

Therefore, not only will the brake be activated on over design speed, but it will be activated in the case of velocity over the leveling speed with the door open which would indicate a control valve operation, and also on operation above the leveling speed in the leveling zone when there is a call to stop in that zone, this indicating a control maloperation It is possible to operate only on one of the two braking assemblies, selecting the one operable in the current direction of travel. It is much preferable, however, to operate both, since there is no detriment to operating the alternate brake, and the alternate brake also operates to prevent reverse movement of the car once it is stopped.

Figure 5:
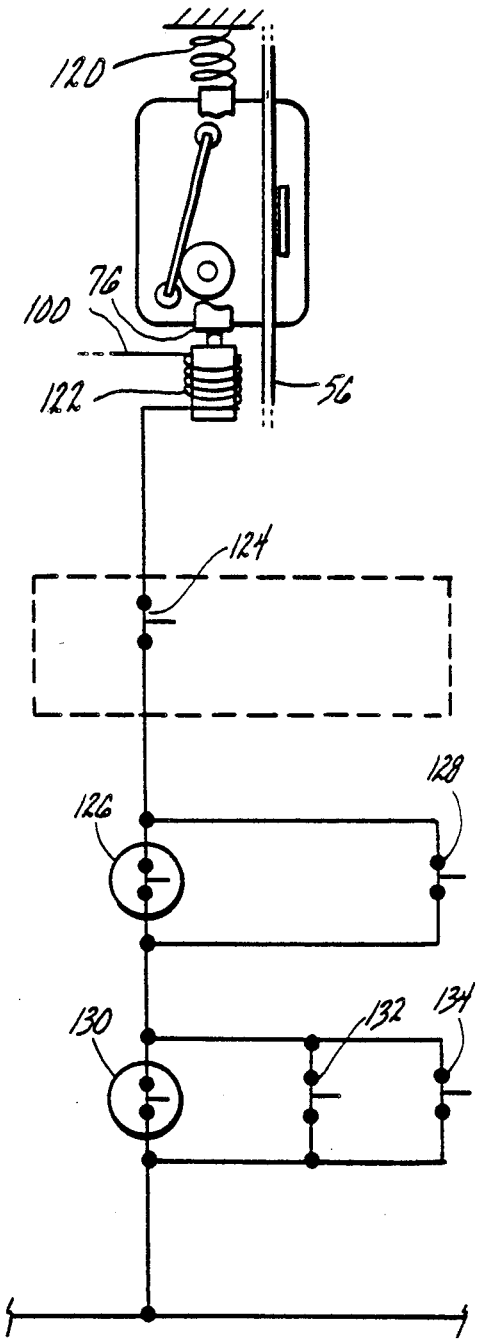
FIG. 5 is a control diagram of a deenergize to trip system.

FIG. 5 illustrates another control scheme with the solenoid normally energized and thereby requiring deenergization to trip. In this case, a helical spring 120 maintains linkage 76 in the upward condition causing the roller to be activated into contact with the spring and the sheave braking disk 56. Energization of solenoid 122 operates against the spring to hold the roller out of contact.

Normally closed governor overspeed switch 124 is opened on overspeed thereby deenergizing the coil and permitting the spring to initiate the braking action. In series with this is a parallel circuit with contact 126 being closed at velocities less than the leveling condition and opened at velocities above this 10 feet permitted or similar system permitted velocity. In parallel with contact 126 is contact 128 which opens if the car door 44 is opened and closed if it is not. Accordingly, only if both contactors 126 and 128 are opened is the braking action initiated.

Further in series is a parallel arrangement of contactors 130, 132 and 134. Contactor 130 opens on a velocity greater than 10 feet per minute or similar system allowable maximum leveling speed, while contactor 132 opens within the leveling zone. Contactor 134 opens either if there is a hall or a car call for stopping at the particular floor under consideration.

Such Austrian safety is conventionally used on the car rails in activation of the device causes the knurled portion 140 of the roller to bite into the rail. This has been known to cause some scoring of the rail surface which interferes with the conventional guide bearings of the car on the guide rails, and normally must be removed by filing the rails. When the safety is used on the braking ring secured to the sheave, the brake pad operates against one surface with the knurled roller operating against the other. Substantial deformation of the roller side of the braking ring can be tolerated without interfering with normal operation of the elevator system.

We claim

1. In an elevator system having a rope supported car, a rope supported counterweight, a rope drive sheave, and a rope connecting said car and said counterweight and passing over said sheave, a safety braking system comprising:

a support structure;

a safety brake ring on said sheave having a sheave braking surface comprising an annular outwardly extending disk, said disk having parallel axially facing surfaces; 'a first housing secured to said support structure and adapted for receiving said disk;

at least one first brake shoe attached to said first housing and located on at least one side of said disk, and at a first circumferential location;

a first spring assembly attached to said first housing at said first circumferential location and operable to urge said first brake shoe against said brake ring;

progressive engagement means for directing said first brake shoe into resilient braking engagement with said disk under the influence of said first spring assembly; and first initiation means for initially directing said progressive engagement means toward said first brake shoe.

2. An apparatus as in claim 1 further comprising:

a second housing secured to said support structure and adapted for receiving said disk;

at least one second brake shoe attached to said second housing and located on at least one side of said disk, and at a second circumferential location;

a second spring assembly attached to said second housing at said second circumferential location and operable to urge said second brake shoe against said brake ring;

progressive engagement means for directing said second brake shoe to resilient braking engagement with said disk under the influence of said second spring assembly;

second initiation means for initially directing said progressive engagement means toward said second brake shoe.

3. An apparatus as in claim 1 further comprising:

said first brake shoe attached to said first housing and located on one side of said disk, and at said first circumferential location;

said first spring assembly attached to said first housing defining a first tapered area on a second side of said disk opposite said one side at said first circumferential location;

said progressive engagement means comprising a roller located within said first tapered area adapted to be directed initially toward the narrow end of said first tapered area to engage said second side of said disk, and thereby be forced progressively further toward the narrow end by rolling on said disk as said disk rotates;

a stop in said first tapered housing at the narrow end of said area, engageable with said roller to limit the travel thereof; and said initiation means comprising means for initially directing said first roller toward said narrow end.

4. An apparatus as in claim 3 further comprising:

a second housing secured to said support structure and adapted for receiving said disk;

a second brake shoe attached to said second housing and located on one side of said disk at a second circumferential location;

a second spring assembly attached to said second housing and defining a second area on a second side of said disk opposite said one side at said second circumferential location;

a second roller located within said second tapered area adapted to be directed initially toward the narrow end of said second tapered area to engage said second side of said disk, and thereby be forced progressively further toward the narrow end by rolling on said disk as said disk rotates;

a stop within said second housing at the narrow end of said second tapered area engageable with said second roller, to limit the travel thereof; and said initiation means for initially directing said second roller toward said narrow end.

5. An apparatus as in claim 1 wherein:

said initiation means are responsive to any one of:

car overspeed;

car speed greater than leveling speed in the leveling zone in the presence of a call to stop in that zone; and car speed greater than leveling speed with the car door open.

6. An apparatus as in claim 2 wherein:

said initiation means are responsive to any one of:

car overspeed;

car speed greater than leveling speed in the leveling zone in the presence of a call to stop in that zone; and car speed greater than leveling speed with the car door open.

7. An apparatus as in claim 3 wherein:

said initiation mean are responsive to any one of:

car overspeed;

car speed greater than leveling speed in the leveling zone in the presence of a call to stop in that zone; and car speed greater than leveling speed with the car door open.

8. An apparatus as in claim 4 wherein:

said initiation means are responsive to any one of:

car overspeed;

car speed greater than leveling speed in the leveling zone in the presence of a call to stop in that zone; and car speed greater than leveling speed with the car door open.

* * * * *